US006543376B1

(12) United States Patent
Breivik et al.

(10) Patent No.: US 6,543,376 B1
(45) Date of Patent: Apr. 8, 2003

(54) MODULE DEVICE FOR INSTALLATION IN A VESSEL, FOR RECEIVING A SUBMERGED BUOY OR THE LIKE

(75) Inventors: Kare Breivik, Tau (NO); Trygve G. Egge, Hafrsfjord (NO); Harald Kleppesto, Bryne (NO); Arild K. Samuelson, Tananger (NO)

(73) Assignee: Navion ASA, Stavanger (NO)

( * ) Notice: Subject to any disclaimer, the term of this patent is extended or adjusted under 35 U.S.C. 154(b) by 0 days.

(21) Appl. No.: 09/673,054

(22) PCT Filed: Apr. 7, 1999

(86) PCT No.: PCT/NO99/00115

§ 371 (c)(1),
(2), (4) Date: Dec. 1, 2000

(87) PCT Pub. No.: WO99/52764

PCT Pub. Date: Oct. 21, 1999

(30) Foreign Application Priority Data

Apr. 8, 1998 (NO) ..... 98627

(51) Int. Cl.[7] ..... B63B 21/00; B63B 22/02

(52) U.S. Cl. ..... 114/230.12; 441/3

(58) Field of Search ..... 114/230.1, 230.12; 441/3, 4, 5

(56) References Cited

U.S. PATENT DOCUMENTS 3,590,407 A * 7/1971 Bratianu ..... 114/256
5,279,245 A * 1/1994 Braud et al. ..... 114/230.13
5,292,271 A * 3/1994 Boatman et al. ..... 441/3

* cited by examiner

*Primary Examiner*—S. Joseph Morano
*Assistant Examiner*—Andy Wright
(74) *Attorney, Agent, or Firm*—Scully, Scott, Murphy & Presser

(57) ABSTRACT

A device for installation in a floating vessel which is intended for receiving a buoy or a turret in a submerged receiving space at the bottom of the vessel. The device comprises a tubular body (5) dimensioned for installation in a shaft (2) extending vertically through the hull of the vessel and which, at its lower end, is arranged to receive a module unit (6) provided with a through opening (8) for receiving the buoy/turret. When the module unit (6) is installed in the tubular body (5), the module unit at its lower end forms a seal (37) against the tubular body (5), and at its upper end the module unit (6) is fixed in relation to the tubular body (5) by locking means (40).

10 Claims, 7 Drawing Sheets

MODULE DEVICE FOR INSTALLATION IN A VESSEL, FOR RECEIVING A SUBMERGED BUOY OR THE LIKE

The invention relates to a device for installation in a floating vessel intended for receiving a buoy or a turret in a submerged receiving space at the bottom of the vessel.

A device of this type is of current interest in connection with vessels for use in offshore production and/or transport of hydrocarbons, and especially vessels of the type having a submerged receiving space for the receipt and releasable securing of a socalled STL or STP buoy. These are buoys of the type comprising a bottom-anchored centre member and an outer buoyancy member which is rotatably mounted on the centre member and is conically upwards tapering and arranged to be received in a corresponding receiving space at the bottom of the topical vessel. An STL buoy is a buoy which is constructed for loading/ unloading, the abbreviation "STL" standing for "Submerged Turret Loading". An STP buoy is a buoy which is constructed for use in connection with a production vessel, the abbreviation "STP" standing for "Submerged Turret Production".

In connection with the development of the STL/STP technology it has become topical to use ships which are constructed or may be adapted to be used for several different applications, i.e. multi-purpose or MST ships (MST=Multi Service Tanker). Such ships may, for example, be used as shuttle tankers, the ships then being arranged to receive an STL buoy, or they may—after a possible conversion—be used as production ships—the ships then being arranged for receiving an STP buoy or a rotating body or turret which is dimensioned and adapted for the topical purpose.

When contracting and building such ships, it may sometimes be uncertain to which conditions of use or which field-specific requirements the ship in the first instance is to be adapted. This may then result in expensive postponements/delays before the ship can be finished, or it may become necessary to undertake expensive rebuildings/ conversions for adaptation to the topical requirements.

On this background it is an object of the invention to provide a device which will enable quick and reasonable conversions of MST ships with short tender and decision terms.

Another object of the invention is to provide a device making it possible to avoid expenditures for building of receiving spaces and assembly of equipment for which—at the building stage—one is uncertain whether it will be used.

For the achievement of the above-mentioned objects there is provided a device of the introductorily stated type which, according to the invention, is characterized in that it comprises a tubular body dimensioned for installation in a shaft extending vertically through the hull of the vessel and which, at its lower end, is arranged to receive a module unit provided with a through opening for receiving the buoy/ turret, the module unit, when installed in the tubular body, at its lower end forming a seal against the tubular body, and at its upper end being fixed in relation to the tubular body by a locking means.

Apart from the fact that the solution according to the invention, which is based on the use of prefabricated module units, enables quick and reasonable conversions of MST ships, it also enables a quick and reasonable replacement of a module unit in case of changes in field-specific requirements to buoy or turret. A short conversion time will be a competition advantage in an FPSO market (FPSO=Floating Production and Storage of Oil) where the time from the commercial decision about field development is taken to the "first oil on deck" often is essential for the economy of the field.

In an advantageous embodiment of the device according to the invention the tubular body at its lower end is provided with a peripherally extending base which is conically downwards tapering, for the support of the correspondingly tapering portion of the module unit. The conically tapering base will provide for centering of the module unit in the tubular body and will also act as a force/weight distributor. Between the base and the tapering portion of the module unit there will be provided a sealing means which is to prevent water ingress between the body and the module unit.

By means of said locking means at the upper end of the module unit, the module unit can be fastened to the inner wall of the body, and thereby welding and burning in assembly/disassembly can be avoided. As a consequence of the fact that welding and burning are avoided, one can to a greater extent preassemble and finish equipment which is to be placed at the top of the module unit, while this is still not installed. This simplifies the installation procedure and makes this less vulnerable to delays as a result of unforeseen problems with functional tests, etc.

The invention will be further described below in connection with exemplary embodiments with reference to the drawings, wherein FIG. 1 shows a partly sectioned side view of a vessel during assembly of a device according to the invention;

In the various drawing figures corresponding parts and elements are designated by the same reference numerals.

Figure 1:
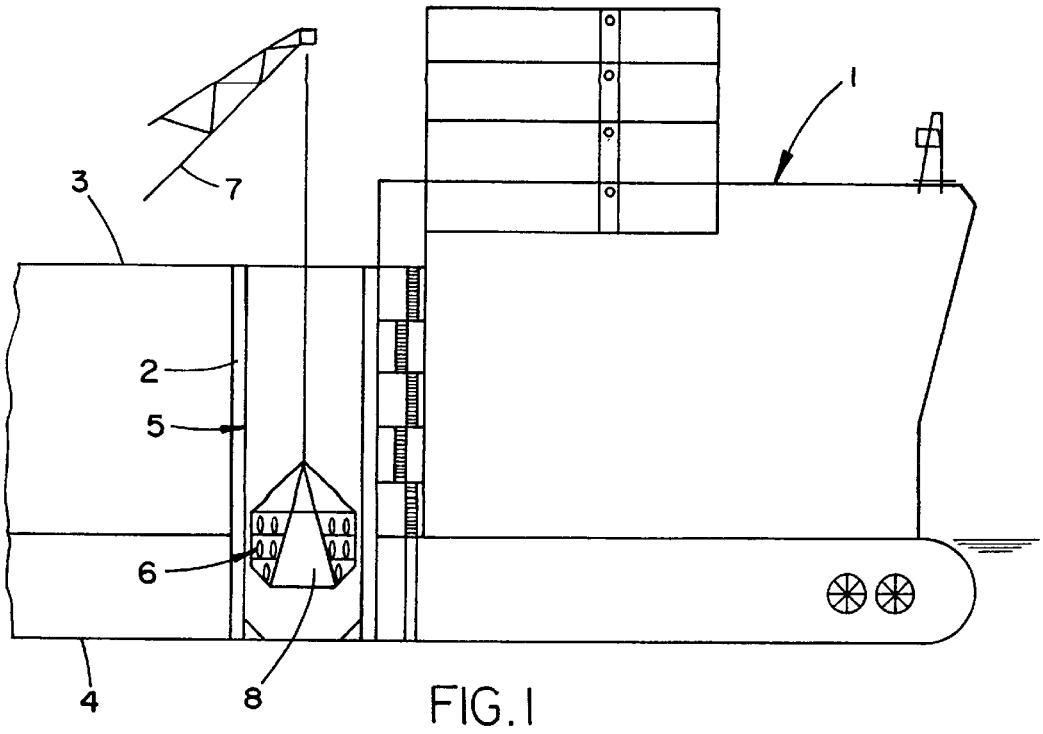

In FIG. 1 there is schematically shown a vessel 1, e.g. an MST vessel, which is provided with a vertical shaft 2 extending through the vessel hull from the deck 3 to the bottom 4 of the vessel. A device according to the invention is installed in the shaft 2. The device comprises a hollow, tubular or cylindrical body 5 which extends through the whole shaft 2 and at its lower end is arranged to receive a prefabricated module unit 6. The tubular body 5 may have a diameter in the range 10–20 m, and may suitably be constructed to withstand explosions. The module unit 6 is self-supporting and shall be able to be lifted on board the ship by means of floating or travelling cranes having a lifting capacity of less than 200 tons. As shown in the Figure, the module unit is in the process of being lowered in place in the tubular body 5 by means of a crane 7.

Figure 2:
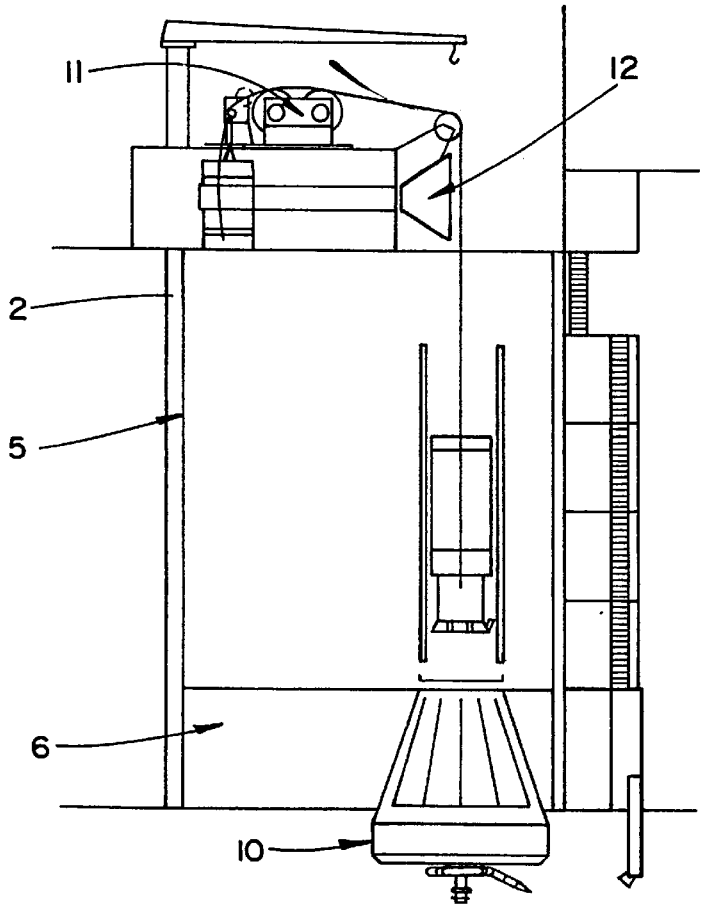
FIGS. 2–4 show examples of alternative module units used in connection with different buoy and turret arrangements.
Figure 3:
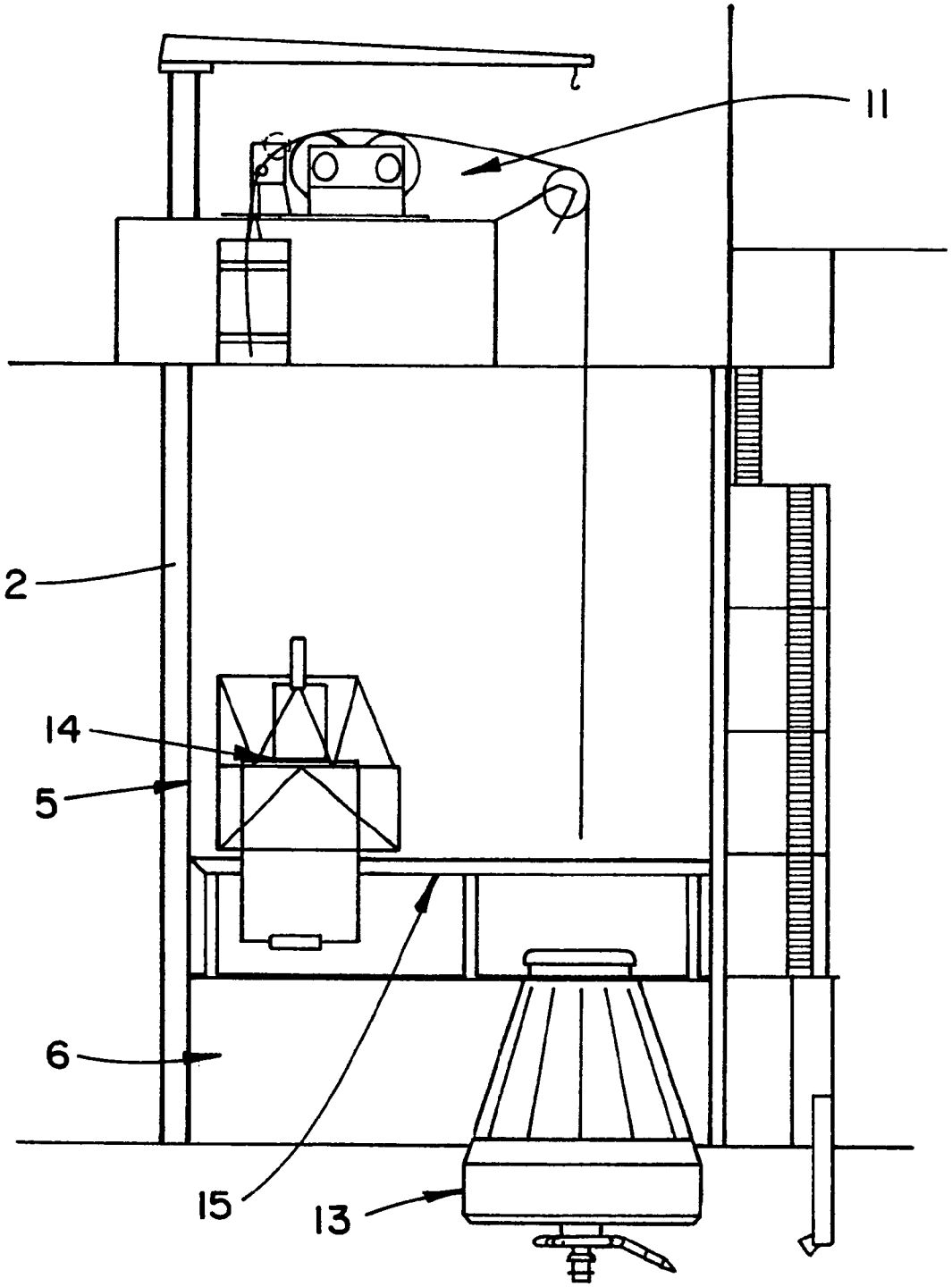
Figure 4:
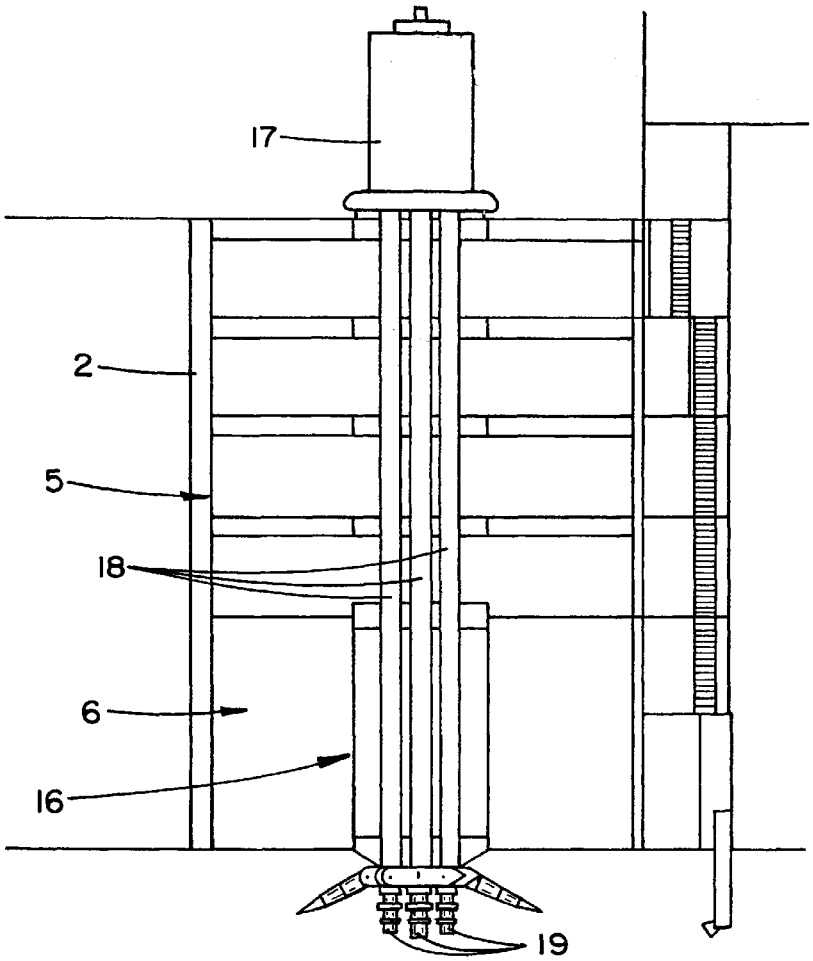

As further appears, the module unit 6 is provided with a vertically through-going opening 8 forming a space for the receipt of a buoy or a rotating body or turret, as shown for example in FIGS. 2–4. When the module unit is installed in the tubular body 5, it forms a seal against the body, and at its upper end it is fixed in relation to the tubular body, as further described with reference to FIGS. 6–12.

FIGS. 2–4 show practical examples of use wherein the module unit 6 is mounted in the tubular body 5 in connection with different buoy or turret arrangements. Thus, FIG. 2 shows a module unit 6 in which there is introduced an STL buoy 10. The buoy is hoisted in place by means of a winch 11 with an associated compensator 12 placed on the deck of the vessel. As mentioned in the introduction, the buoy comprises a central member which is anchored to the sea bed by means of a non-illustrated anchoring system, and an outer member which is releasably secured in the opening 8 by means of a suitable locking mechanism, e.g. as shown in NO 175 422.

FIG. 3 shows a buoy 13 which is introduced and locked in the opening in the module unit 6. It is here the question of an STP buoy for use in the production of hydrocarbons, and the arrangement is shown to comprise a swivel unit 14 cooperating with the buoy and which, by a rail means 15, can be brought in position above the buoy and interconnected with pipe courses in the central member thereof.

In the embodiment in FIGS. 2 and 3, the opening in the module unit 6 as shown is conically upwards tapering, to receive a buoy having a corresponding external shape. In the embodiment in FIG. 4 the module unit on the other hand is provided with a circularly cylindrical opening for the receipt of a matching rotating body or turret 16. It is here the question of a fixed turret solution, wherein the bottom-anchored turret is not to be disconnected, but is permanently installed in the module unit 6. As appears, a swivel unit (rotating connector) 17 in this embodiment is mounted at the deck of the vessel, pipe connections 18 extending through the turret up to the swivel unit, the pipes at their lower end being connected to risers 19 which are connected to the turret at the underside thereof.

Figure 5:
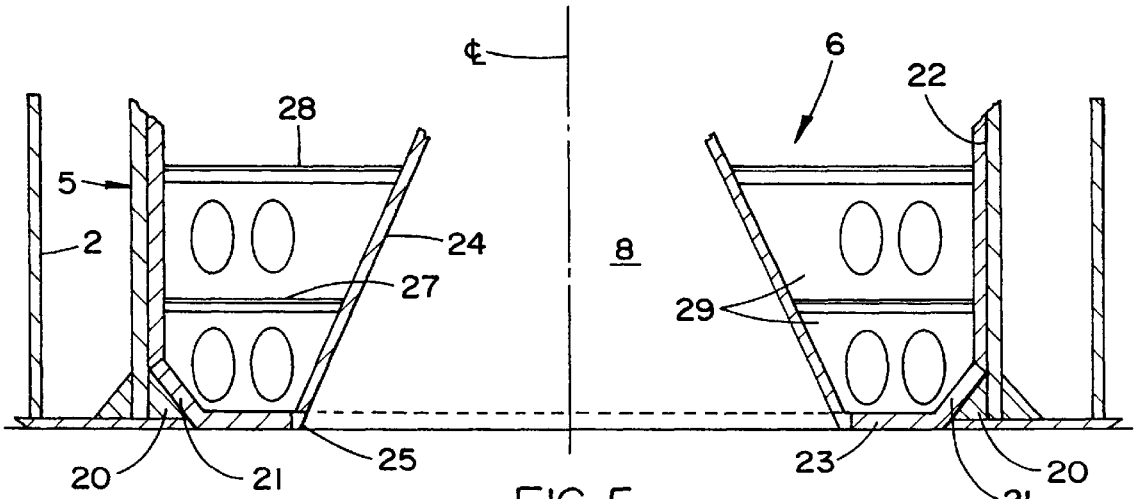
FIG. 5 shows an enlarged, axial sectional view of the lower part of the tubular body and a module unit which is supported by the supporting base of the tubular body.

FIG. 5 shows an axial sectional view of the lower part of the tubular body 5 and a prefabricated module unit 6. As appears, the tubular body at its lower end is provided with a peripherally extending base 20 which is conically downwards tapering, for the support of a correspondingly tapering, conical side wall or bottom wall portion 21 of the module unit. Thus, the supporting base 20 forms an abutment or matching cone for centering of the module unit 6 in the tubular body 5 when the module unit is lowered when installed in the tubular body. Such a centering and correct positioning of the module unit is important, as in practice there must be a certain clearance (see FIGS. 9–11) between the outer wall of the module unit and the inner wall of the tubular body, in order that the module unit shall not jam during the lowering in the tubular body.

In the embodiment in FIG. 5, the through opening of the module unit is conical, for the receipt of a corresponding STL/STP buoy. The opening or space 8 is arranged centrally in the module unit, so that the centre line CL of the module unit is coincident with the centre line of the STL/STP space 8. The tubular body 5 as well as the module unit 6 are constructed from welded steel plates. As mentioned above, the module unit is self-supporting, and is constructed for transfer of all horizontal and vertical loads occurring during operation, from the buoy (or turret) to the tubular body 5 and to the hull of the vessel in which the device is installed. The supporting base 20 of the tubular body here acts as a force and weight distributor.

In the embodiment in FIG. 5 the conical bottom wall portion 21 of the module unit forms a transition between its cylindrical outer wall 22 and an annular bottom plate 23. The bottom plate passes into the conical inner wall 24 via a cone ring 25. The top of the module unit is formed from an annular top plate 26 (shown only in FIGS. 6 and 9). Further, the module unit is shown to be stiffened by a number of interior stiffening elements, more specifically by a pair of horizontal annular plates 27, 28 and a number of vertical, perforated plate elements 29.

For ballast reasons the module unit will be filled with water when it has been installed in the tubular body.

FIG. 5 also shows a lower wall portion of the aforementioned shaft 2 which extends vertically through the topical vessel. The annular space between the shaft wall 2 and the cylindrical wall of the tubular body 5 normally will be designed as a water-tight space (cofferdam).

Figure 8:
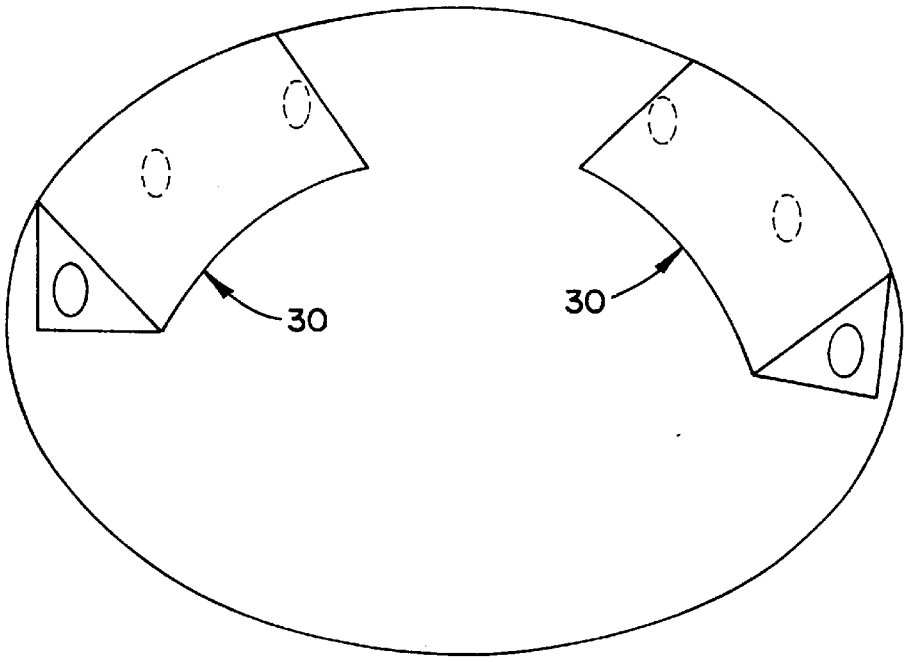
FIG. 8 shows a perspective view of segment parts of the conical supporting base.

The supporting base or matching cone 20 of the tubular body 5 may be formed as shown in FIG. 8, more specifically from a number of curved segments 30, which are welded to the inner wall of the tubular body.

Figure 6:
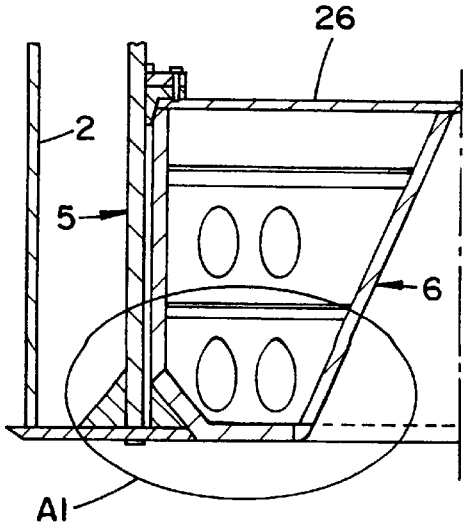
FIG. 6 shows an axial section of a lower portion of the tubular body and a part of a module unit with associated sealing means and locking means.
Figure 7:
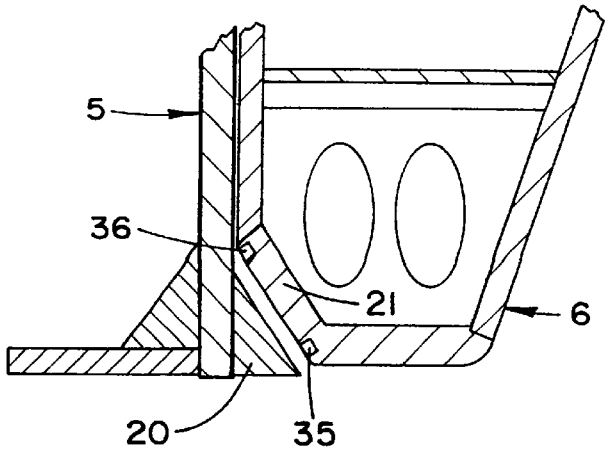
FIG. 7 shows the detail A1 with the sealing means in FIG. 6 on an enlarged scale.

Between the supporting base 20 of the tubular body and the corresponding cone portion 21 of the module unit there is provided a sealing means to prevent ingress of water therebetween. In FIGS. 6 and 7 such a sealing means is shown to consist of a pair of annular gaskets 35 and 36 which are placed in respective grooves in the conical wall portion 21 of the module unit 6 and form a sealing abutment against the supporting base 20. The gaskets may, for example, consist of rubber.

Figure 9:
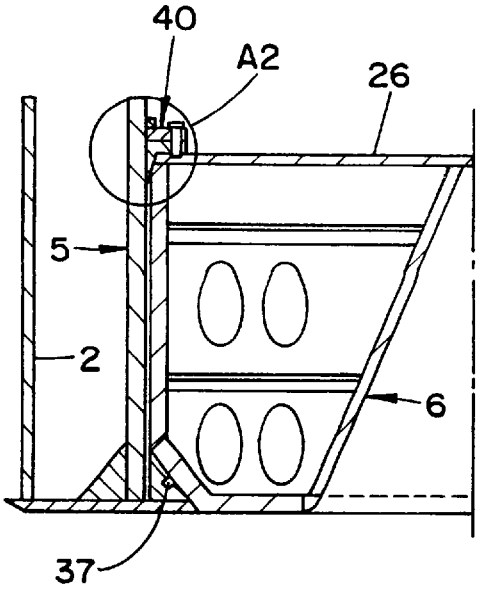
FIG. 9 shows an axial section of a lower portion of the tubular body and a part of a module unit with associated sealing means and locking means.

As an alternative, similar gaskets could be placed in annular grooves in the supporting base 20, as suggested in FIG. 9 wherein there is shown such a gasket 37.

An embodiment of the locking means which is arranged at the upper end of the module unit 6 for fixing thereof in relation to the tubular body 5, is shown in FIGS. 9–12. As appears, the locking means comprises a number of locking assemblies or locking units 40 which are distributed along the periphery of the module unit 6. Each locking unit 40 comprises a centering wedge element 41 placed between the inner wall of the tubular body 5 and a conical top portion 42 of the outer wall 22 of the module unit 6, and a locking element 43 which is placed on top of the wedge element and is fastened thereto in abutment against the inner wall of the tubular body 5. The wedge element 41 is L-shaped in cross-section and has a horizontal portion which is fixed to the module unit 6 by locking bolts 44 which are carried through holes in the wedge elements and are screwed into threaded holes in the top plate 26 of the module unit. The locking element 43 is fastened in a corresponding manner to the wedge element 41 by locking bolts 45 which are carried through holes in the locking elements and are screwed into threaded holes in the wedge element. Instead of using separate locking bolts for the wedge elements and the locking elements, there may be used common locking bolts which are carried through mutually aligned holes in elements belonging together, as shown in FIG. 9.

Figure 10:
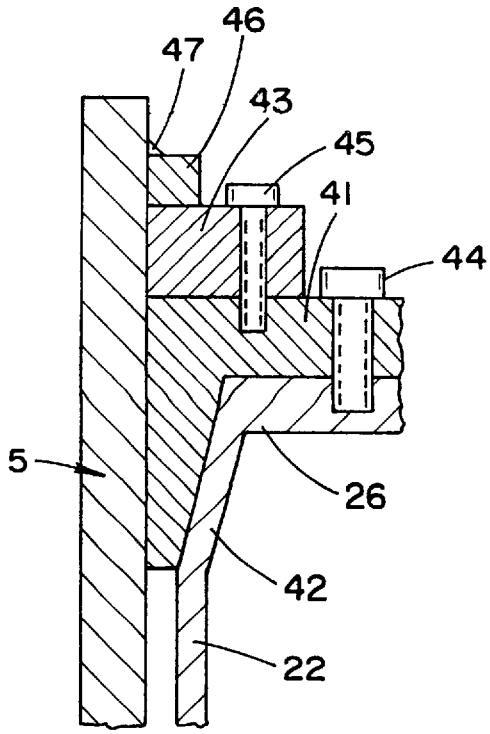
FIG. 10 shows the detail A2 with the locking means in FIG. 9 on an enlarged scale.
Figure 11:
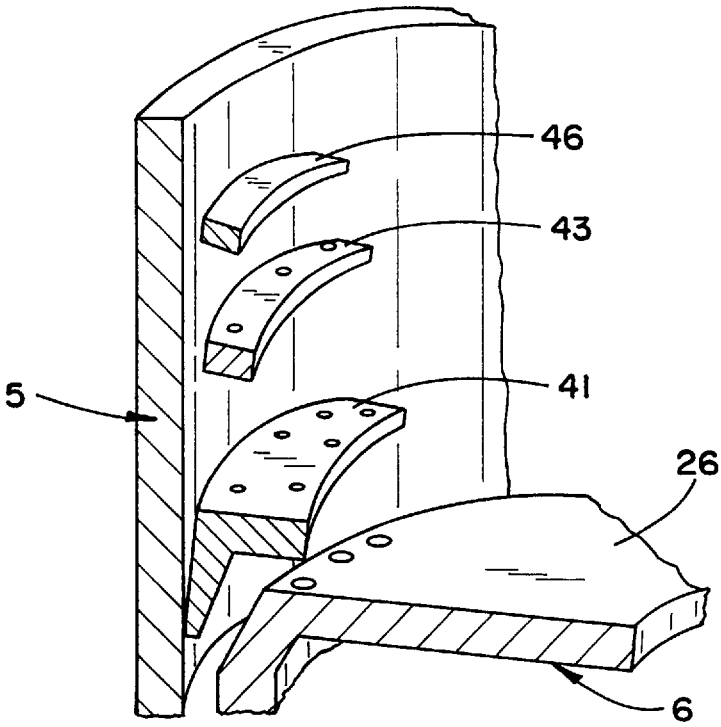
FIG. 11 shows an exploded view of parts of the locking means in FIG. 10.
Figure 12:
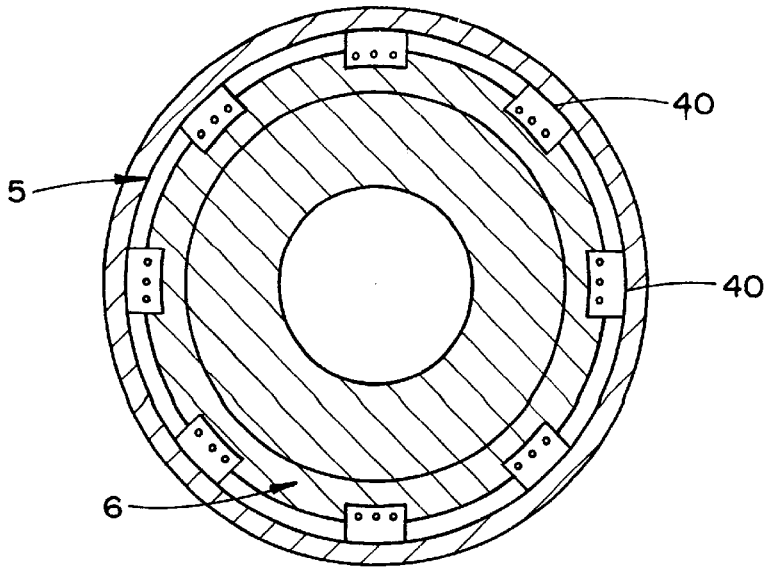
FIG. 12 shows a cross-sectional view, as viewed from above, of the tubular body, and of the module unit with peripherally distributed locking means according to FIG. 10.

The wedge elements 41 have a centering as well as a weight-distributing function, whereas the locking elements have the function of absorbing upwards directed, vertical forces occurring during operation, when the module unit has been installed in the vessel and receives a buoy or a turret. In order to absorb said vertical forces, the locking element is fixed in relation to the inner wall of the tubular body 5, in the illustrated case by means of welding. Moreover, for extra security, an abutment element 46 is placed on top of each locking element 43, and is fastened to the inner wall of the tubular body by welding, as shown in FIG. 10 at the weld 47.

The illustrated design of the locking units is advantageous because of the centering and weight-distributing function of the wedge elements. The number of utilized wedge elements depends on the maximum load which is to be transferred to the tubular body.

It will be clear that the locking means can be designed in many other different ways, also without wedge elements. For example, the module unit can be locked by means of a number of locking elements which are fastened in a suitable manner to the module unit, and which e.g. are in engagement in a horizontally extending groove in the inner wall of the tubular body. In such an embodiment welding will be unnecessary.

Figure 13:
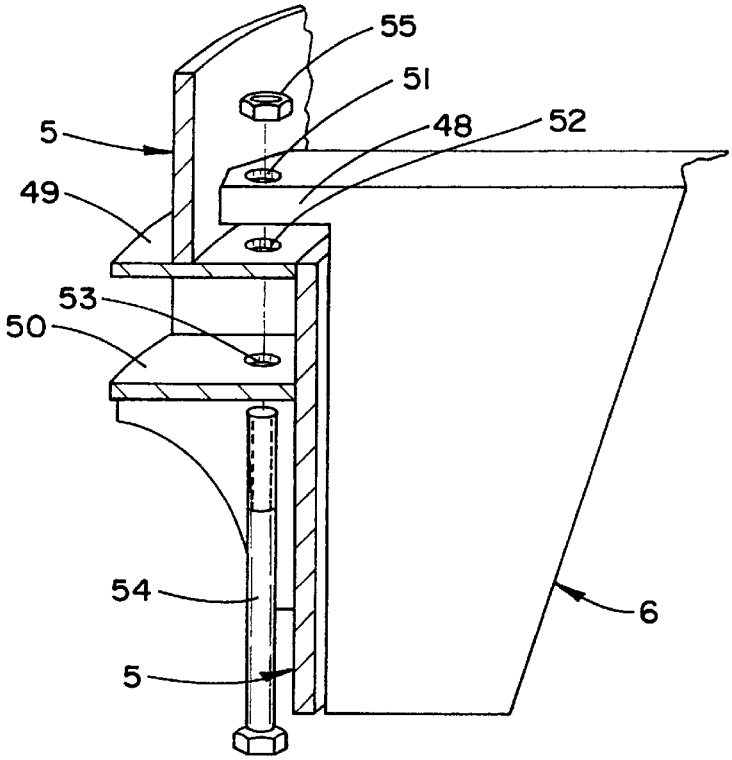
FIGS. 13 and 14 show two additional embodiments of the locking means.
Figure 14:
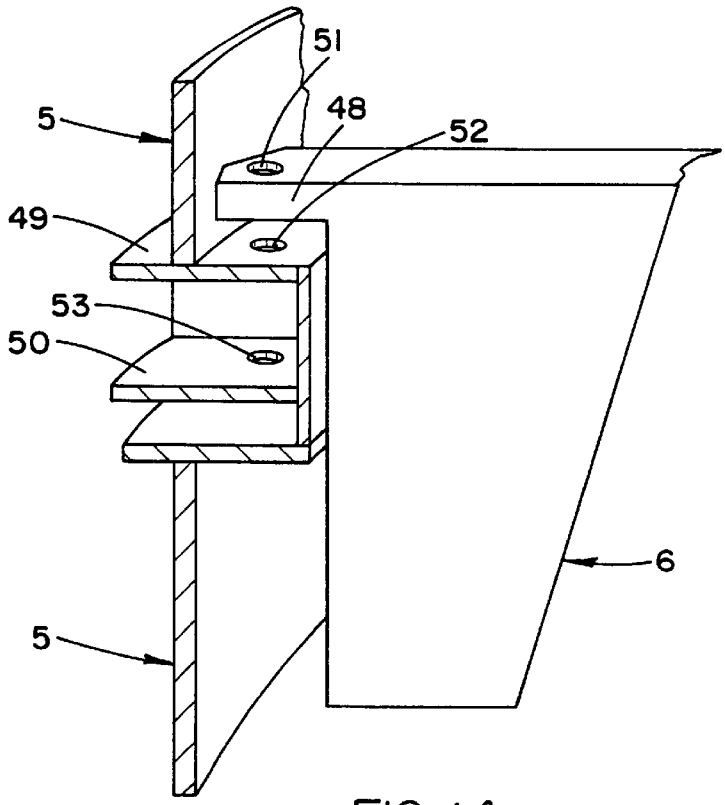

Additional embodiments of the locking means are suggested in FIGS. 13 and 14. In both of these embodiments the module unit 6 is provided with a number of peripherally distributed, radially outwards directed projections 48 which are adapted for connection with radially inwards directed flange members 49, 50 which are mutually stiffened and fastened in a suitable manner, for example by welding, to the tubular body 5. The projections of the module unit and the flange members are provided with vertically aligned holes 51, 52, 53 for receiving respective locking bolts 54 of which each is provided with an associated fastening nut 55. The flange members may extend continuously along the periphery of the tubular body 5, or they may consist of peripherally distributed units. In the embodiment of FIG. 13, the lower part of the tubular body 5 has a smaller diameter than the upper part and is rigidly connected to the radially inner edge portions of the flange members 49, 50. In the embodiment of FIG. 14, on the other hand, the flange members are situated between upper and lower parts of the tubular body 5, and the upper and lower parts are shown to have the same diameter.

In time periods when the tubular body 5 is not utilized, i.e. does not receive a module unit after having been installed in a vessel, it will be advantageous to mount a dummy unit in the lower end of the tubular body, so that the dummy unit then forms a bottom frame or a tight bottom portion of the tubular body.

Figure 15:
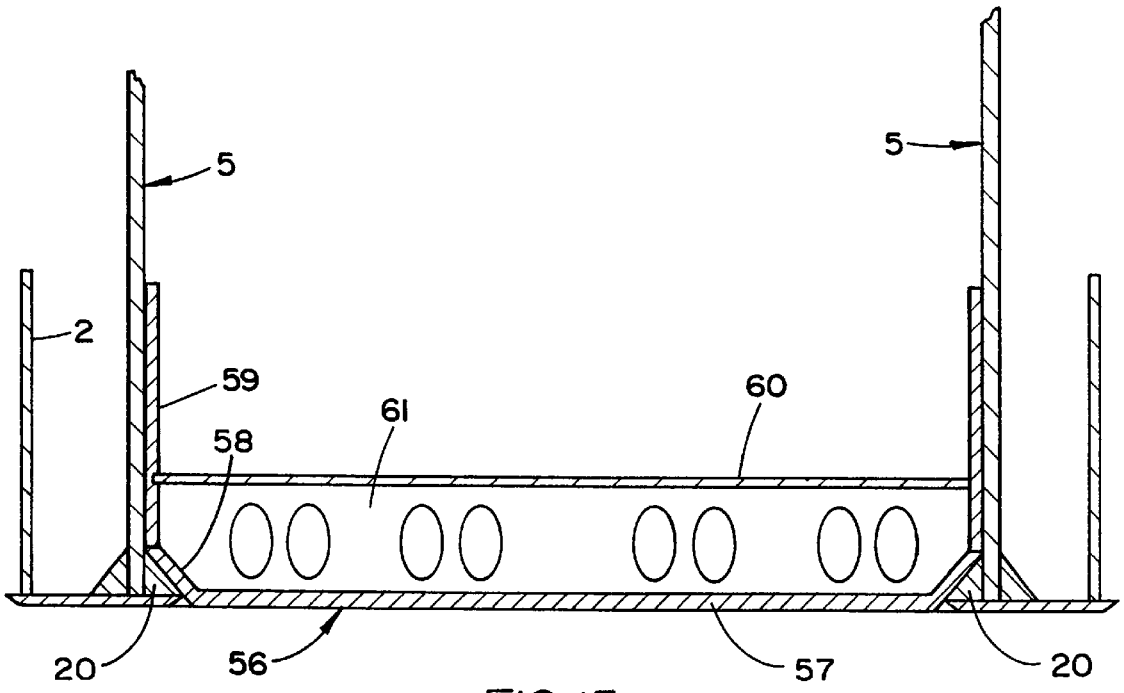
FIG. 15 shows an axial sectional view of the lower part of the tubular body and a blind or dummy element which is placed on and supported by the conical supporting base of the body.

An embodiment of such a dummy unit 56 if schematically shown in FIG. 15. As shown, the dummy unit comprises a bottom plate 57 passing into a conical portion 58 matching with the supporting base 20 of the tubular body 5, a cylindrical outer wall 59, a top plate 60 and interior stiffening elements 61. At its upper end the dummy unit is provided with suitable locking units (not shown in FIG. 15) for fixing in relation to the tubular body 5. These may be of a design which is similar to the locking units discussed above. The provision of such a dummy unit will again secure that one is let off burning or welding in the hull in case of a possible conversion, and in addition that one avoids dry-docking in this connection.

What is claimed is:

1. A device for installation in a floating vessel (1) intended for receiving a buoy (10; 13) or a turret (16) in a submerged receiving space at the bottom of the vessel, CHARACTERIZED IN that it comprises a tubular body (5) dimensioned for installation in a shaft (2) extending vertically through the hull of the vessel (1) and which at its lower end, is arranged to receive a module unit (6) provided with a through opening (8) for receiving the buoy or turret (10; 13; 16), the tubular body (5) at its lower end being provided with a peripherally extending base (20) which is conically downwards tapering, for support of a correspondingly tapering portion (21) of the module unit (6); the module unit (6), when installed in the tubular body (5), at its lower end having said portion (21) forming a sealing means (35; 36; 37) against the tubular body (5), and at its upper end being fixed in relation to the tubular body (5) by a locking means (40).

2. A device according to claim 1, CHARACTERIZED IN that said sealing means (35; 36; 37) for preventing water ingress is arranged between the base (20) of the tubular body (5) and the corresponding portion (21) of the module unit (6).

3. A device according to claim 2, CHARACTERIZED IN that the sealing means comprises at least one gasket (37) which is placed in an annular groove in the supporting base (20) of the tubular body (5).

4. A device according to claim 2, CHARACTERIZED IN that the sealing means comprises at least one gasket (35, 36) which is arranged in an annular groove in the tapering portion (21) of the module unit (6).

5. A device according to claim 1, CHARACTERIZED IN that the module unit (6) is self-supporting and is constructed for transfer of all horizontal and vertical loads from the buoy/turret (10; 13; 16) to the tubular body (5) and to the hull of the vessel (1) in which the device is installed.

6. A device according to claim 1, CHARACTERIZED IN that the locking means (40) comprises a number of centering wedge elements (41) for placing between the inner wall of the tubular body (5) and a conical top portion (42) of the module unit (6), the wedge elements (41) being provided with fastening elements (44) for fastening of the wedge elements to the module unit (6).

7. A device according to claim 6, CHARACTERIZED IN that, on top of the wedge elements (41), there is placed a locking element (43) which is arranged to be fastened to the wedge element (41) in question in abutment against the inner wall of the tubular body (5), and to be fixed in relation to the inner wall, for absorption of occurring vertical forces.

8. A device according to claim 7, CHARACTERIZED IN that the locking element (43) is fastened to the inner wall of the tubular body (5) by welding.

9. A device according to claim 1, CHARACTERIZED IN that the locking means comprises radially inwards directed flange members (49, 50) fastened to the tubular body (5) and arranged for interconnection with radially outwards directed projections (48) on the module unit (6), the flange members and the projections being provided with vertically aligned holes (51, 52, 53) for receiving associated locking bolts (54).

10. A device according to claim 1, CHARACTERIZED IN that it comprises a dummy unit (56) which is arranged to be mounted in the lower end of the tubular body (5) and to form a tight bottom portion of the body (5) when this does not receive a module unit (6).

* * * * *